US008211003B2

(12) United States Patent
Betke

(10) Patent No.: US 8,211,003 B2
(45) Date of Patent: Jul. 3, 2012

(54) SWING-OUT UNIT FOR A CENTRIFUGE HAVING SKEWED SAMPLE VESSEL RECESSES

(75) Inventor: Viktor Betke, Hannover (DE)

(73) Assignee: Thermo Electron LED GmbH, Langenselbold (DE)

( * ) Notice: Subject to any disclaimer, the term of this patent is extended or adjusted under 35 U.S.C. 154(b) by 167 days.

(21) Appl. No.: 12/499,337

(22) Filed: Jul. 8, 2009

(65) Prior Publication Data

US 2010/0009834 A1 Jan. 14, 2010

(30) Foreign Application Priority Data

Jul. 8, 2008 (DE) ..... 10 2008 032 073

(51) Int. Cl.
*B04B 5/02* (2006.01)

(52) U.S. Cl. ..... 494/20; 422/548

(58) Field of Classification Search ..... 494/16, 494/20, 21, 23, 27, 30, 31, 33, 36, 60; 422/72, 422/548, 562; 211/74; 220/512–513; 206/427
See application file for complete search history.

(56) References Cited

U.S. PATENT DOCUMENTS 4,295,601 A * 10/1981 Cowell ..... 494/20
4,883,644 A * 11/1989 Perlman ..... 422/562
4,941,867 A 7/1990 Tominaga
5,605,529 A * 2/1997 Petithory ..... 494/16
6,045,494 A * 4/2000 Toyama ..... 494/16
6,986,731 B2 * 1/2006 Fondin et al. ..... 494/16
7,131,544 B1 * 11/2006 Cunningham ..... 211/74
2002/0035023 A1 3/2002 Miura et al.
2005/0079064 A1 4/2005 Shimizu et al.
2005/0221972 A1 10/2005 Lurz
2010/0009834 A1 * 1/2010 Betke ..... 494/20

FOREIGN PATENT DOCUMENTS

DE 101 45 171 A1 4/2002
JP 54068573 A * 6/1979

OTHER PUBLICATIONS

United Kingdom Intellectual Property Office, Patents Act 1977: Search Report Under Section 17, Application No. GB0911528.8, date of search Oct. 20, 2009 (1 page).

* cited by examiner

*Primary Examiner* — Charles E Cooley
(74) *Attorney, Agent, or Firm* — Wood, Harron & Evans, LLP

(57) ABSTRACT

The present invention relates to a swing-out unit for a centrifuge, with the swing-out unit comprising sample vessel recesses and being insertable in a centrifuge rotor head to be swivelable about a swing-out axis, with the axes of at least two sample vessel recesses being arranged in a skewed manner with respect to one another. As a result, more sample vessels can be inserted in a swing-out unit than was previously possible with limited overall space.

8 Claims, 7 Drawing Sheets

SWING-OUT UNIT FOR A CENTRIFUGE HAVING SKEWED SAMPLE VESSEL RECESSES

RELATED APPLICATION

The present application claims the priority under 35 U.S.C. §119 of German Patent Application No. 102008032073.0, filed Jul. 8, 2008, the disclosure of which is hereby incorporated herein by reference in its entirety.

FIELD OF THE INVENTION

The present invention relates to a swing-out unit for a centrifuge and, more particularly, to a rotor head for receiving such a swing-out unit and an associated centrifuge for such a swing-out unit.

BACKGROUND OF THE INVENTION

A centrifuge can be arranged in such a way that one or several swing-out units can be used. A swing-out unit comprises a fixture with at least two lateral receptacles which can be connected with a rotor head of a centrifuge in an articulated manner. When the rotor head of the centrifuge rotates, a centrifugal force acts upon the swing-out unit. This force leads to the consequence that a swing-out unit moves or swings out with its base outwardly towards the wall of the centrifuge vessel. Such a process can be compared with the movement of a passenger gondola in a carousel. In the case of a sufficiently high rotational speed of the rotor head, the swing-out unit will swing to a horizontal position, with the base of the swing-out unit being close to the wall of the centrifuge vessel, while the head of the swing-out unit will be arranged close to the rotor axis.

A swing-out unit usually accommodates tubular sample vessels which contain matter to be centrifuged. The sample vessels are inserted into sample vessel recesses arranged parallel with respect to one another. The recesses are either contained directly in a swing-out unit or in a cup, insert or adapter which has been inserted in such a swing-out unit. The number of sample vessels that can be received by such a swing-out unit or such a cup is limited by the space predetermined by the swing-out unit.

There is generally an interest to centrifuge as many samples as possible within a short period of time. The time for centrifuging usually cannot be reduced because this would mean a higher rotational speed, through which the samples might be damaged or an insignificant result would be achieved in samples treated in this manner. A remedy could be to use a larger centrifuge, so that more sample vessels can be accommodated. This approach is no solution when there is little space for a centrifuge. This approach is also not viable in existing centrifuges whose dimensions are fixed.

Therefore, there is a need for a swing-out unit, a rotor head and centrifuge that allows more sample vessels than before to be centrifuged in the same time during a centrifuging process with the given space for a centrifuge. There is also a need for such a swing-out unit that may be employed in already existing centrifuges and is thus downwardly compatible, and is cost-effective at the same time.

SUMMARY OF THE INVENTION

The swing-out unit for a centrifuge in accordance with one embodiment of the present invention comprises sample vessel recesses and can be inserted in a centrifuge rotor head to pivot about a swing-out axis, with the axes of at least two sample vessel recesses being arranged in a skewed manner with respect to one another. The present invention contemplates that an entirely different volume is available for the head region and the base region of a swing-out unit.

The head region is delimited by the arrangement of the rotor head or rotor cross and the base region by the wall of the centrifuge vessel. The available space in the region of the rotor head is predetermined by the shape of the rotor arms and the arrangement of the rotor hub of the rotor head.

As seen in general, the space for receiving the sample vessels decreases continually the closer the vessels are placed to the central point of the rotor head. Conversely, the space for receiving the sample vessels increases more the closer the vessels are arranged in the region of the wall of the centrifuge vessel. The space for receiving sample vessels increases with rising distance from the central point of the rotor head.

In order to keep the outer dimensions for a centrifuge as small as possible, the volumes in the head region and the base region of a swing-out unit can be utilized better and thus more sample vessels can be accommodated in these regions when the axes of at least sample vessel recesses are arranged in a skewed manner with respect to one another. It is also possible that the axes of all sample vessel recesses of a swing-out unit are arranged in a skewed manner with respect to one another. The surface area jointly available in the head region and in the base region is utilized jointly in the case of a parallel arrangement of sample vessels as is common practice in the state of the art.

As a result of the present invention, the intersecting quantity of both regions is no longer required. Instead, the different volumes can be utilized better. The usual rotational speeds can be set in an unchanged manner, so that more sample vessels than before can be centrifuged in the same time. The use of computer-controlled production machines allows producing skewed sample vessel recesses in a simple manner and with high precision. The swing-out units can also be produced in large numbers by means of injection molding. The swing-out units can be produced from one piece or can be joined from several parts.

The available space for accommodating sample vessels can be optimized further and thus be as large as possible when the outer edge of the base region of a swing-out unit is produced in the swung-out state by an intersection of a first plane with a first arched surface, with the first plane extending parallel to the swing-out axis of the swing-out unit present on the rotor head in an extension of the rotor head axis in the region between the swing-out axis and the vessel wall of the centrifuge, and the first arched surface is arranged in such a way that a section of an arc of a circle whose central point is arranged in the rotor head axis and whose radius lies in the region between the vessel wall and the swing-out axis is pivoted about the swing-out axis. In such a construction, the shape of an ellipse is obtained as the outer edge, with the long main axis of the ellipse being arranged horizontally in the swung-out state of the swing-out unit and the central point of the ellipse is arranged in an associated main axis of the rotor head and thus perpendicular to the swing-out axis. The surface within the ellipse is then the base region which can be used for placing sample vessels. The sample vessels are arranged in the region of the base of the swing-out unit approximately at a common level. A small variation of the base heights of sample vessels provides advantages concerning the utilization of space in addition to the skewed arrangement.

Higher security in the rotation is achieved when the radius of the arc of a circle as mentioned above is formed from the radius of the vessel wall of the centrifuge reduced by a safety margin and a minimum thickness of the base of the swing-out unit. The safety margin considers the fluctuations in concentric running and movements of a swing-out unit in the radial direction during concussions caused from outside or inside the centrifuge. The likelihood is smaller in such a construction that a collision will occur between the swing-out unit and the vessel wall of the centrifuge during a rotation of the rotor head.

In the head region of the swing-out unit, the largest possible space for receiving sample vessels can be determined in the following manner: The outer edge of the head of the swing-out unit is formed by an intersection of a second plane with a second arched surface, with the second plane extending parallel to the swing-out axis of the swing-out unit present on the rotor head in an extension of the rotor head axis in the region between the swing-out axis and the rotor head axis, and the second arched surface is formed in such a way that a third plane which is formed by the swing-out axis, the body edges of the associated rotor arms facing the swing-out axis and the rotor hub of the rotor head is pivoted about the swing-out axis. Within a surface formed by an outer edge thus formed, sample vessels can be arranged without colliding with the rotor head, with the largest possible surface area being provided at the same time. The second plane represents the surface in which the upper edges of the sample vessel are arranged at approximately the same common level.

In a further embodiment of the present invention, the envelope of the sample vessel recesses in their base region is a circle whose central point is disposed in the central axis of the swing-out unit. As a result, the swing-out unit can have a circular shape instead of an elliptical shape. It can be produced more easily from a production viewpoint and with respect to the production costs. Furthermore, an already existing swing-out unti which has a circular cross section and can accommodate only a circular insert or adapter with recesses for sample vessels can be provided with an insert which comprises axes for sample vessel recesses which are arranged in a skewed manner. The number of sample vessels that can be accommodated can be higher than before despite the circular geometry when the sample vessels have a conically tapering base region, so that conical recesses are also arranged in the base region of the swing-out unit. As a result of the conical geometry, the need for space in the base region can be arranged more narrowly than in the case of exclusively cylindrical recesses.

The advantages of the present invention are also achieved by a centrifugal head with a swing-out unit as described above and a centrifuge with such a centrifuge head.

BRIEF DESCRIPTION OF THE DRAWINGS

The invention is described below in closer detail by reference to embodiments shown schematically in the drawings, wherein.

DETAILED DESCRIPTION OF THE INVENTION

Figure 1:
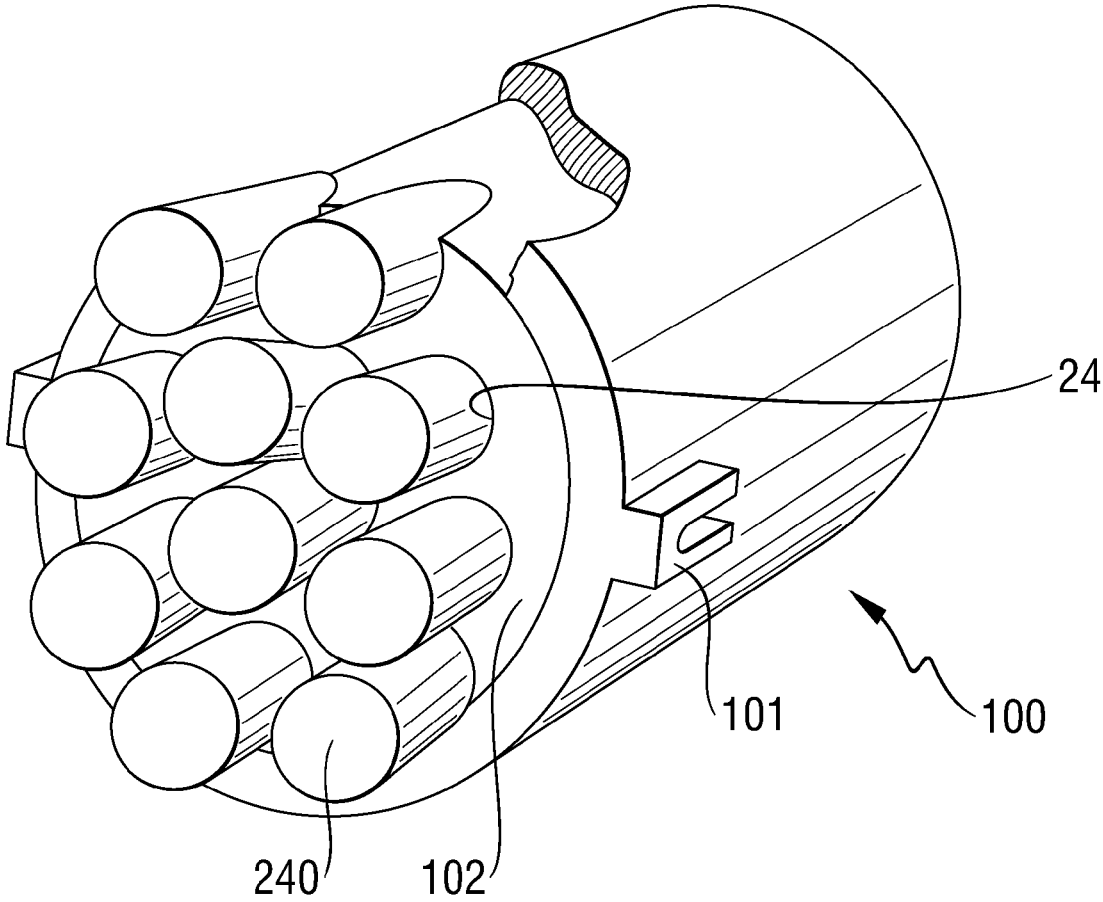
FIG. 1 shows a perspective view of a swing-out unit according to one embodiment of the present invention.
Figure 7:
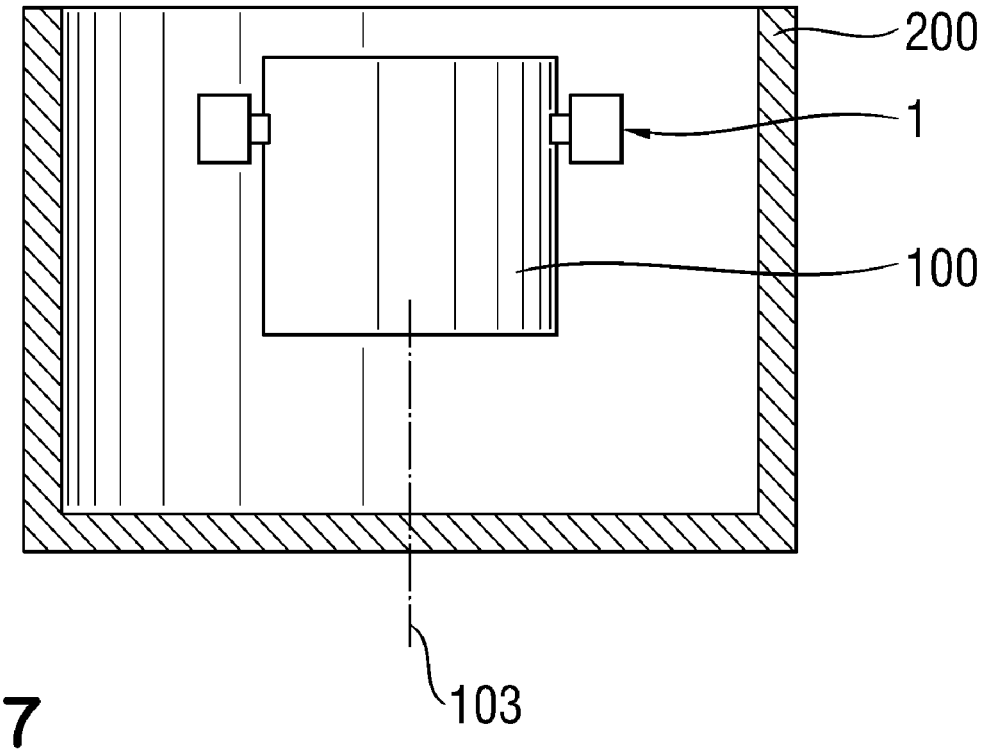
FIG. 7 shows a centrifuge with a swing-out unit in accordance with one embodiment of the present invention.

Referring now to the figures. FIG. 1 shows a swing-out unit in accordance with a first embodiment of the present invention 100 in a perspective view. The swing-out unit 100 comprises a recess 101 at the edge which corresponds with a bearing pin of a rotor head 1 of a centrifuge 200 (see FIG. 7). An adapter or insert 102 is arranged within the swing-out unit 100 which is provided with recesses 24 for accommodating sample vessels 240.

Figure 2:
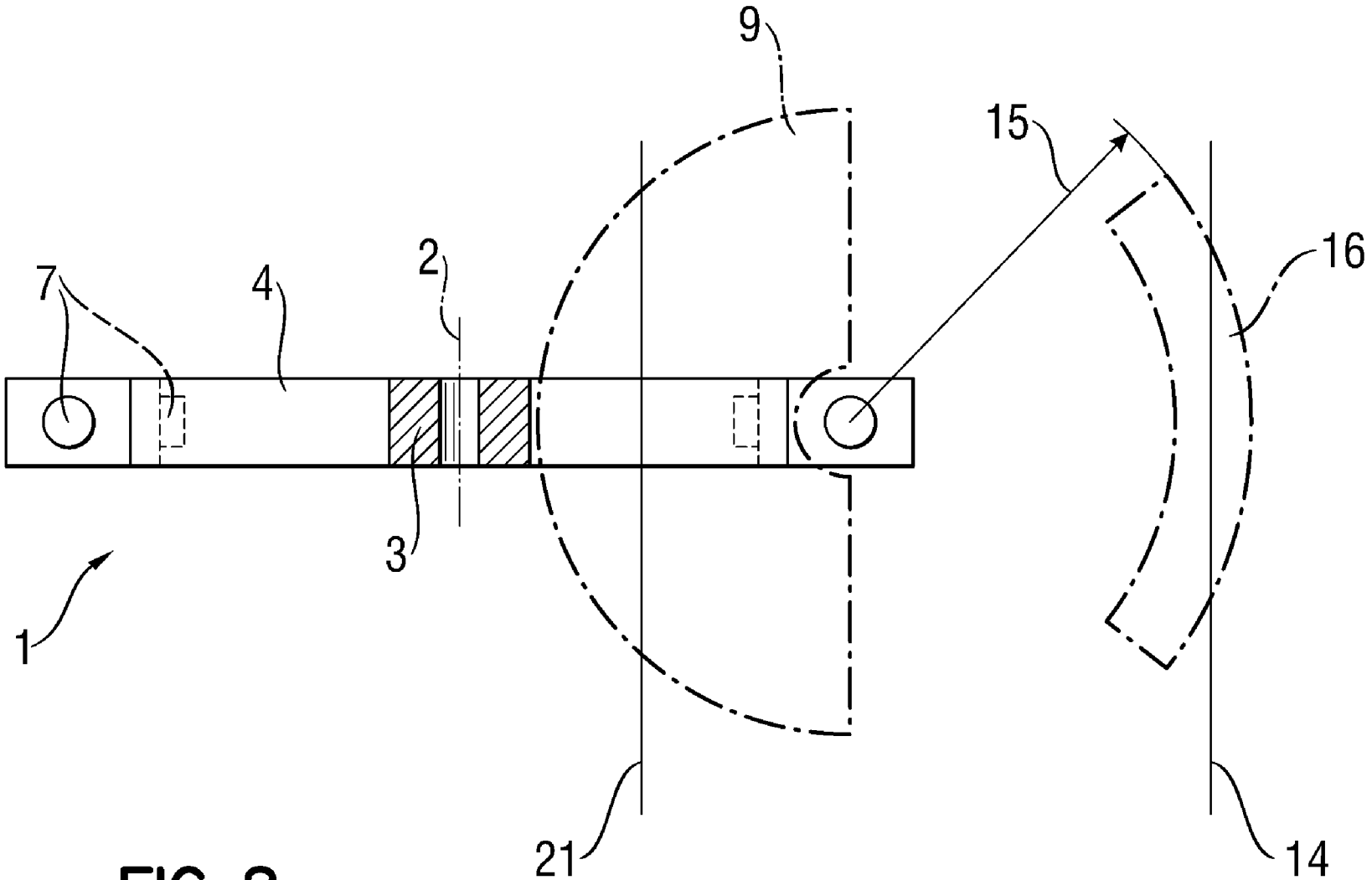
FIG. 2 shows a side view of a rotor head for a swing-out unit in accordance with one embodiment of the present invention.
Figure 3:
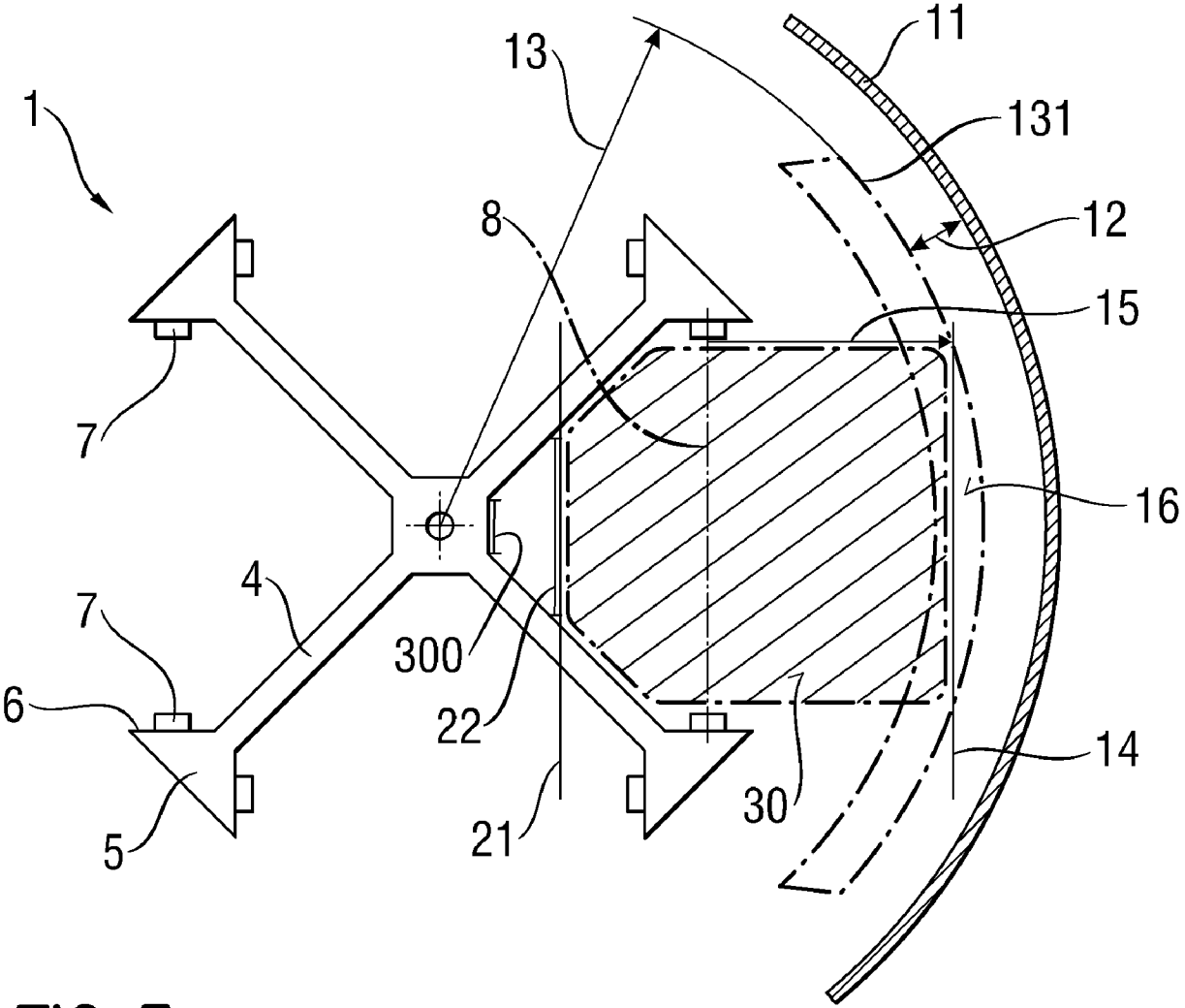
FIG. 3 shows a top view of the rotor head according to FIG. 2 with planes of intersection for the arrangement of a swing-out unit in accordance with one aspect of the present invention.

FIG. 2 shows a side view of a rotor head. Rotor head 1 comprises a rotor axis 2 in the geometrical center, with a hub 3 for a rotor head being provided about axis 2 (also see FIG. 5). Rotor head 1 is provided with several arms 4 (see FIG. 3) which protrude radially from the hub 3. In the embodiment as shown in FIG. 3, triangular supports 5 are arranged at the ends of arms 4, on the faces 6 of which outwardly protruding bearing pins 7 are arranged. A bearing pin 7 forms a swing-out axis 8 with an opposite bearing pin of an adjacent arm 4 which forms the swiveling axis of a swing-out unit 100. The bearing pins 7 are provided to engage in the recesses 101 of the swing-out unit 100. A region 9 is disposed between the swing-out axis 8, the associated arms 4 and the side of rotor hub 3, which region is covered by a swing-out unit 100 or its head region when it swings out without any collision occurring with the rotor head 1. The boundary line of region 9 which is the second arched surface is provided with reference numeral 10.

The outer boundary of the swing-out unit is caused by the vessel wall 11 of the centrifuge (see FIG. 3). In order to prevent a collision of a swing-out unit 100 with the vessel wall 11 when the rotor runs eccentrically, a safety distance 12 including the thickness of a base of a swing-out unit is provided in the embodiment of a centrifuge as shown in FIG. 3, so that the radius 13 that can actually be utilized for a swing-out unit is obtained. A segment 131 of this circle formed by the radius 13 is shown in FIG. 3 in such a way that it covers an angle of approximately 90° and thus the region between two arms 4 of rotor head 1. When this segment 131 of a circle is pivoted about the swing-out axis 8, a first curved surface 16 is formed which is shown in FIG. 2 in a side view, in FIG. 3 as a top view and in FIG. 5 in a perspective view.

Figure 5:
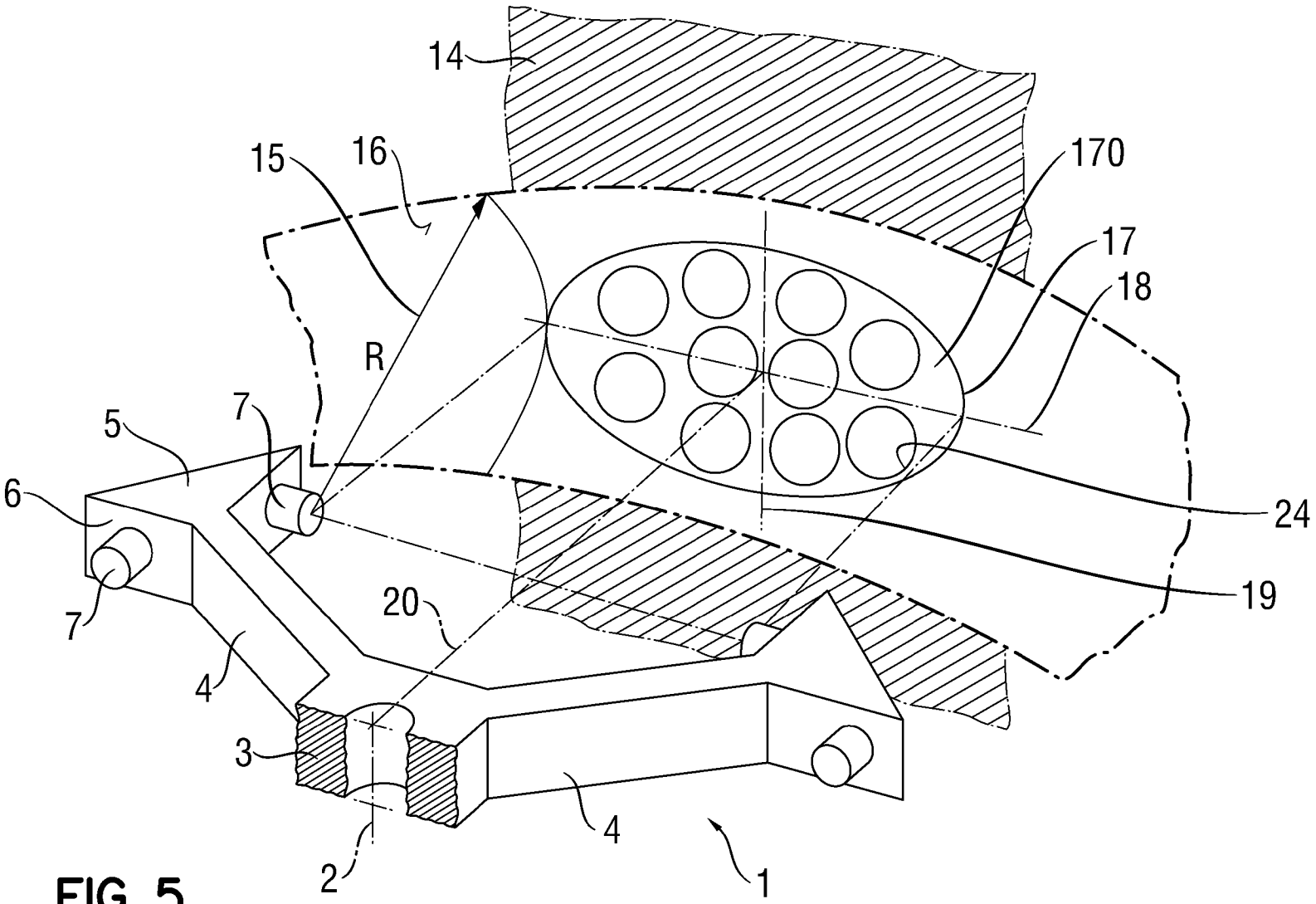
FIG. 5 shows a perspective view of the rotor head and the surfaces for construction of the base region of the swing-out unit in accordance with one embodiment of the present invention.

When a first plane 14 is placed parallel to the swing-out axis 8 in an extension of the rotor head axis 2, which is perpendicular to the plane of the drawing in FIG. 3, in the region between the swing-out axis 8 and the first arched surface 16, said first plane intersects the first arched surface 16. As is shown in FIG. 5, the section of this first plane 14 with the first arched surface 16 forms a first line of intersection 17 which forms the maximum permissible outside edge of the base of a swing-out unit 100 without leading to a collision of swing-out unit 100 with the vessel wall 11 of the centrifuge by taking into account a safety distance. The first line of intersection 17 is ellipsoid and is shown in FIG. 5 in a perspective view. The ellipse comprises a first principal axis 18 and a second principal axis 19 which is arranged perpendicularly in respect of the same, with the central point of the ellipse intersecting the rotor head axis 2 in an extension perpendicular to the seing-out axis 8 through an axis 20. The surface 170 comprised by line of intersection 17 can be used for the arrangement of recesses for sample vessels.

Figure 4:
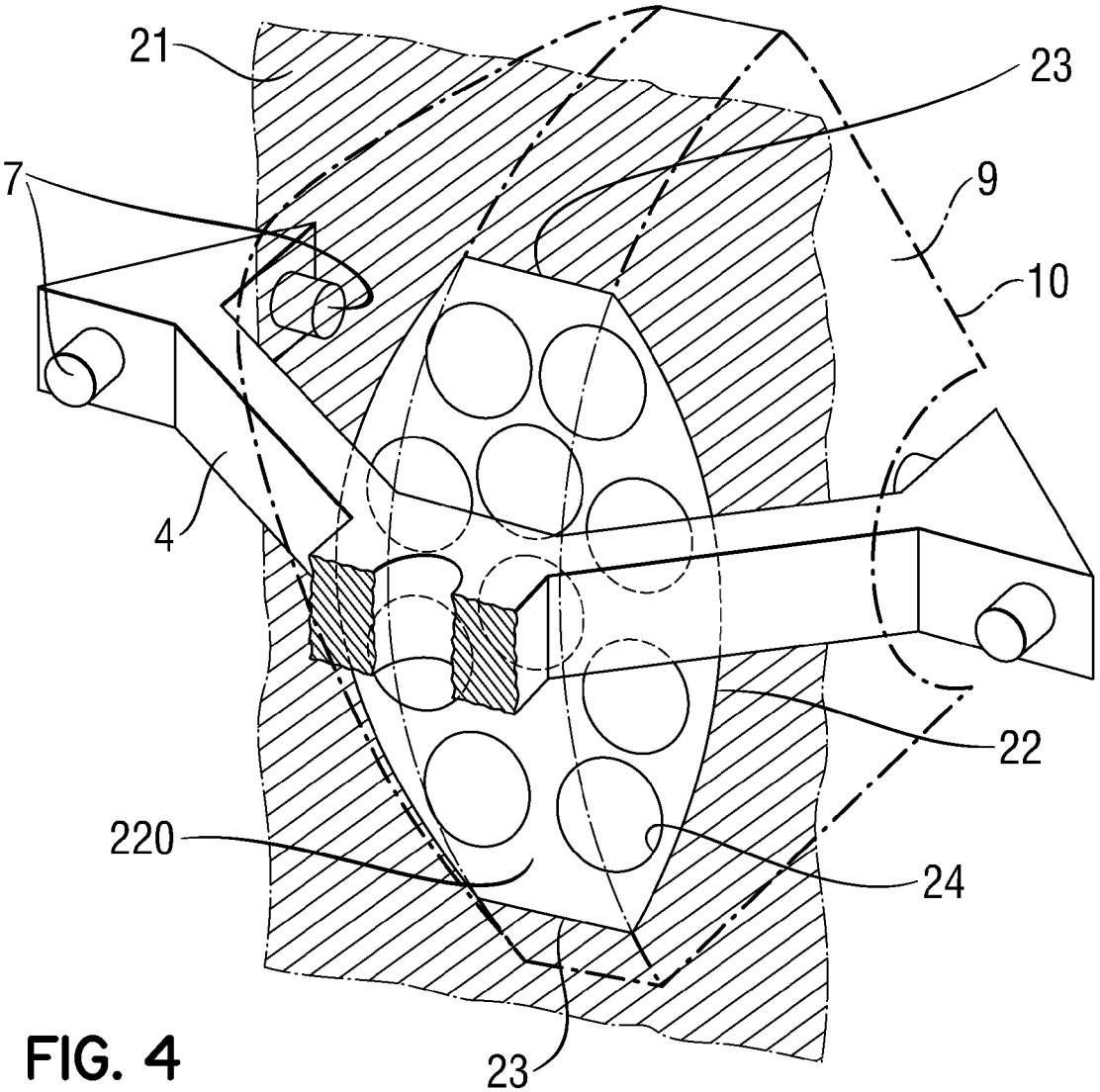
FIG. 4 shows a perspective view of the rotor head and surfaces for constructing the head region of the swing-out unit in accordance with one embodiment of the present invention.

The construction of a permissible head region of a swing-out unit is shown in FIGS. 2 to 4 for example. A second arched surface 9 is produced in the swung-out state in a rotation imagined about the swing-out axis 8 of a region which is enclosed by the swing-out axis 8, the adjacent rotor arms 4 and one side of the rotor hub 3. When a second plane is placed parallel to the swing-out axis 8 in an extension of the rotor head axis 2, i.e. perpendicular to the plane of the drawing in FIG. 3, in a region between the swing-out axis 8 and the rotor head axis 2, it will intersect said second arched surface 9 in the manner that a second line of intersection 22 is formed. As is shown in FIG. 4, the line of intersection 22 is arched in a convex manner at the high sides, with the upper and bottom boundary 23 extending in a horizontal manner. Said horizontal share of the line of intersection 22 is caused by the shape of the rotor hub 3 which represents a straight line 300 in the top view (see FIG. 3). The surface 220 enclosed by the line of intersection 22 can be used for the upper ends of the sample vessels 240 in a swing-out unit with causing a collision with the rotor head 1 during a rotation of the centrifuge rotor head provided with a swing-out unit. A surface 30 is obtained in the top view (see FIG. 3) in which the swing-out unit can be arranged.

Figure 6:
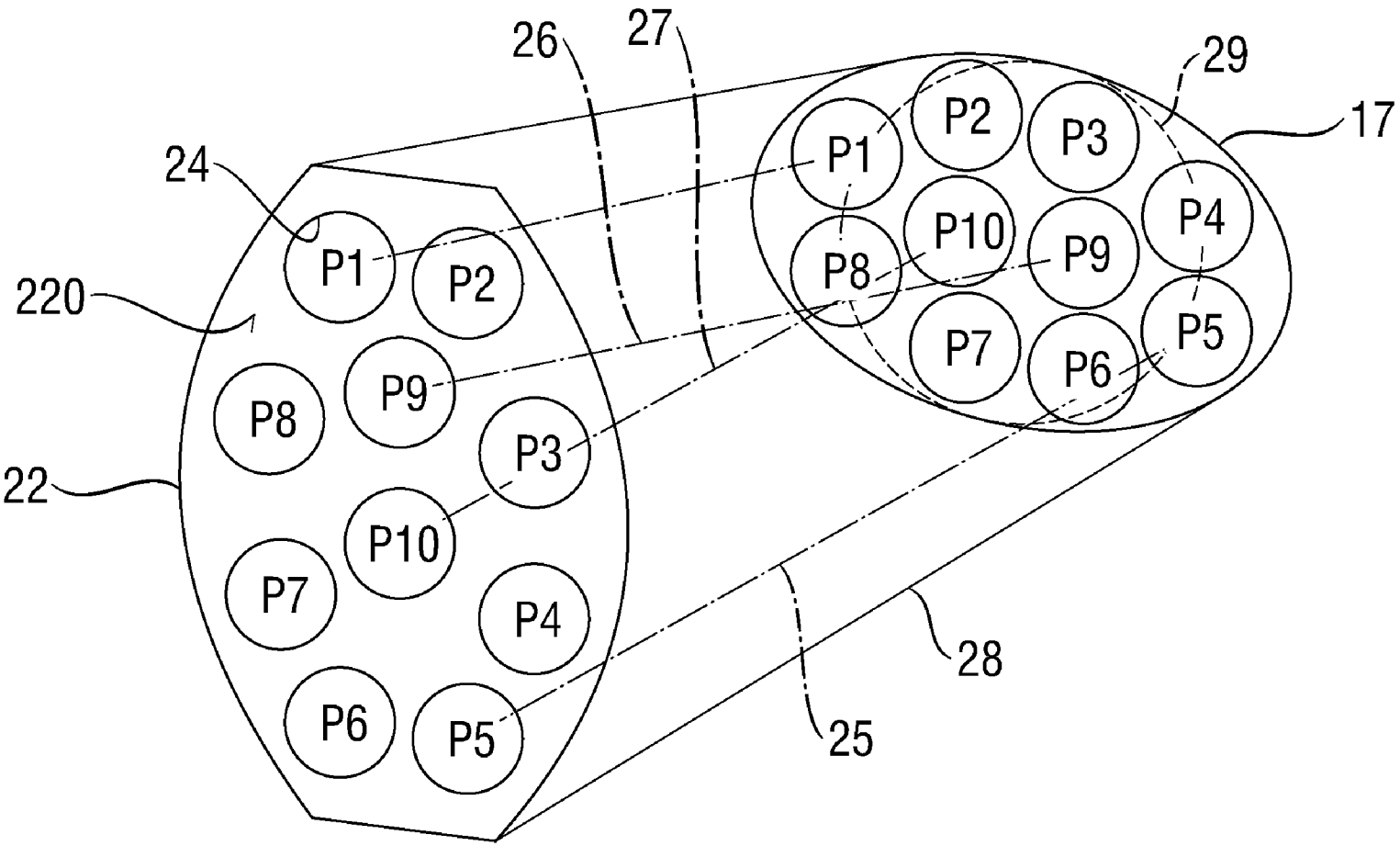
FIG. 6 shows a perspective view of axes of sample vessel recesses in the swing-out unit in accordance with one embodiment of the present invention.

FIG. 6 shows the first line of intersection 17 for the base region and the second line of intersection 22 for the head region of a swing-out unit. It is shown that a surface is available in the head region which is higher than wide, whereas in the base region a surface can be used which is wider than high. In the arrangement in FIG. 6, ten recesses are drawn which are numbered with numbers P1 to P10. The arrangement of axes of recesses 24 for sample vessles is shown by a central axis 25 based on the example of recess number P5. The recesses with the numbers P9 and P10 comprise skewed axes 26 and 27, with recess number P9 being adjacent to recesses P8 and P10 in the head region, whereas in the base region the recess number P9 is adjacent only to recess number P10, but no longer to recess number P8. As a result of the skewed arrangement of the axes of the recesses, the sequence of the recess in the head region can change in comparison with the sequence in the base region.

The first line of intersection 17 is an ellipse which comprises the maximum available region 170 for recesses of sample vessels. It is understood that this region can be arranged smaller and as a circle for example (see broken line 29 in FIG. 6). Such a measure is useful when the adapter 102 in the floor region is to be arranged in a circular way in order to fit into the existing swing-out unit. The sample vessels can be arranged in this case in the base region in a conical way for example, so that the space required there can be smaller.

What is claimed is:

1. A swing-out apparatus for a centrifuge having a rotatable rotor head, comprising:

a swing-out unit configured to be inserted into the centrifuge rotor head and having a pair of mountings configured for engagement with a cooperating pair of supports provided on the rotor head so that the swing-out unit is swivelable about a swing-out axis defined by the pair of supports in response to rotation of the rotor head; and at least two sample vessel recesses provided in the swing-out unit, wherein axes of the at least two sample vessel recesses are arranged in a skewed manner with respect to one another.

2. A swing-out apparatus according to claim 1, wherein at least two sample vessel recesses of the same length are arranged within the swing-out unit in vertically different positions.

3. A swing-out apparatus according to claim 1, wherein an outer edge of a base of the swing-out unit is produced by an intersection of a first plane with a first arched surface, with the first plane extending parallel to the swing-out axis of the swing-out unit present on the rotor head in an extension of a rotor head axis in a region between the swing-out axis and a vessel wall of the centrifuge, and the first arched surface is arranged in such a way that a section of an arc of a circle whose central point is arranged in the rotor head axis and whose radius lies in the region between vessel wall and swing-out axis is pivoted about the swing-out axis.

4. A swing-out apparatus according to claim 3, wherein the radius of the arc of a circle is formed from the radius of the vessel wall of the centrifuge, reduced by a safety distance and a minimum thickness of the base of the swing-out unit.

5. A swing-out apparatus according to claim 3, wherein the outer edge of a head of the swing-out unit is formed by an intersection of a second plane with a second arched surface, with the second plane extending parallel to the swing-out axis of the swing-out unit in an extension of the rotor head axis in the region between the swing-out axis and the rotor head axis, and the second arched surface is formed in such a way that a third plane which is formed by the swing-out axis, body edges of the associated rotor arms facing the swing-out axis and a rotor hub of the rotor head is pivoted about the swing-out axis.

6. A swing-out apparatus according to claim 1, wherein an envelope of the sample vessel recesses in their base region is a circle whose central point is disposed in a central axis of the swing-out unit.

7. A rotor head for a centrifuge, wherein a swing-out apparatus according to claim 1 is inserted into the rotor head so that the swing-out unit is operable to swing out to an edge of a centrifuge vessel in the presence of sufficient rotational speed of the rotor head.

8. A centrifuge, comprising a rotor head according to claim 7.

* * * * *